US007261615B2

(12) United States Patent
Hoeting et al.

(10) Patent No.: US 7,261,615 B2
(45) Date of Patent: Aug. 28, 2007

(54) DRIFTING REMOTELY CONTROLLED TOY VEHICLE

(75) Inventors: Michael Hoeting, Cincinnati, OH (US); Neil Hamilton, Covington, KY (US)

(73) Assignee: Bang Zoom Design Ltd., LLC, Cincinnati, OH (US)

( * ) Notice: Subject to any disclaimer, the term of this patent is extended or adjusted under 35 U.S.C. 154(b) by 379 days.

(21) Appl. No.: 10/892,962

(22) Filed: Jul. 16, 2004

(65) Prior Publication Data

US 2005/0095953 A1 May 5, 2005

Related U.S. Application Data

(60) Provisional application No. 60/515,989, filed on Oct. 31, 2003.

(51) Int. Cl.
*A63H 30/04* (2006.01)

(52) U.S. Cl. ..... 446/456; 446/437; 446/460

(58) Field of Classification Search ..... 446/460–471, 446/437, 457, 456, 454, 424, 427
See application file for complete search history.

(56) References Cited

U.S. PATENT DOCUMENTS 3,871,129 A * 3/1975 Tong ..... 446/437
4,232,479 A * 11/1980 von Winckelmann ..... 446/457
5,984,032 A * 11/1999 Gremillion et al. ..... 180/14.1

* cited by examiner

*Primary Examiner*—Eugene Kim
*Assistant Examiner*—Urszula M Cegielnik
(74) *Attorney, Agent, or Firm*—Frost Brown Todd LLC

(57) ABSTRACT

A remotely controlled toy vehicle appears to drift when turning, appearing to slide into the turn, by having a rear driving platform that swivels under a main body of a chassis. In addition to making the chassis appear to slide, the rear driving platform induces a tilt of the chassis into the turn, simulating a car suspension shifting toward the slide. Dummy rear wheels attached to pivoting trailing arms assist in obscuring the rear driving platform and make the toy vehicle appear more realistic. Castoring front wheels further enhance the drifting effect.

17 Claims, 10 Drawing Sheets

DRIFTING REMOTELY CONTROLLED TOY VEHICLE

CROSS REFERENCE TO RELATED APPLICATIONS

The present application claims the benefit of U.S. Provisional Application Ser. No. 60/515,989, entitled "DRIFTING RADIO CONTROLLED TOY VEHICLE", filed on 31 Oct. 2003.

FIELD OF THE INVENTION

The present invention relates to motorized toy wheeled vehicles and more particularly to remotely controlled toy vehicles capable of performing trick maneuvers.

BACKGROUND OF THE INVENTION

Remotely controlled (RC) toy vehicles are a perennial favorite among children and adults. Those that are capable of performing trick maneuvers are particularly desired. One such maneuver is "drifting", a term possibly borrowed from snowboarding slang wherein the snowboard slides sideways with respect to the longitudinal axis of the board. Drifting is a word that describes a car sliding through a turn; it has been around since early car races in the late 1800's. In RC toy vehicles, expert drivers attempt to simulate racing maneuvers such as power slides or drifting as a way of rounding a sharp turn quickly. Typically, causing a wheeled toy vehicle to power slide or drift is exceedingly difficult to achieve. Without momentum and reduced frictional contact to the undersurface, the wheeled toy vehicle will merely turn and not slide. Even if able to initiate a slide, the wheeled toy vehicle may tend to lose control, spinning or tumbling, rather than remaining in a drifting orientation maintaining a relatively stable sliding angle. Thus, generally known toy vehicles are not designed to drift, especially if used in a variety of surface conditions, including soil, asphalt, carpeting, hardwood flooring, etc.

Consequently, a significant need exists for a toy vehicle that is capable of drifting, appearing to slide to the side.

BRIEF SUMMARY OF THE INVENTION

The invention overcomes the above-noted and other deficiencies of the prior art by providing a toy vehicle that appears to drift when turned regardless of surface conditions. Moreover, this maneuver does not require an expert to control the vehicle to achieve this look. A rear driving platform swivels with respect to a chassis of a toy vehicle as paired front wheels castor. Thus, when initiating a turn by swiveling, the rear driving platform causes a rear portion of the chassis to drive into the turn with a front portion of the chassis responding with the pair of front wheels castoring in the direction of the turn. Thus, the toy vehicle appears to drift. Since the rear driving platform advantageously remains in control without sliding upon the surface, this drifting maneuver is achieved without limitations of the speed of the toy vehicle being sufficiently high or that the frictional contact of the rear wheels with the underlying surface being sufficiently low. In addition, body roll accentuates the look of drifting.

These and other objects and advantages of the present invention shall be made apparent from the accompanying drawings and the description thereof.

DETAILED DESCRIPTION OF THE INVENTION

Figure 1:
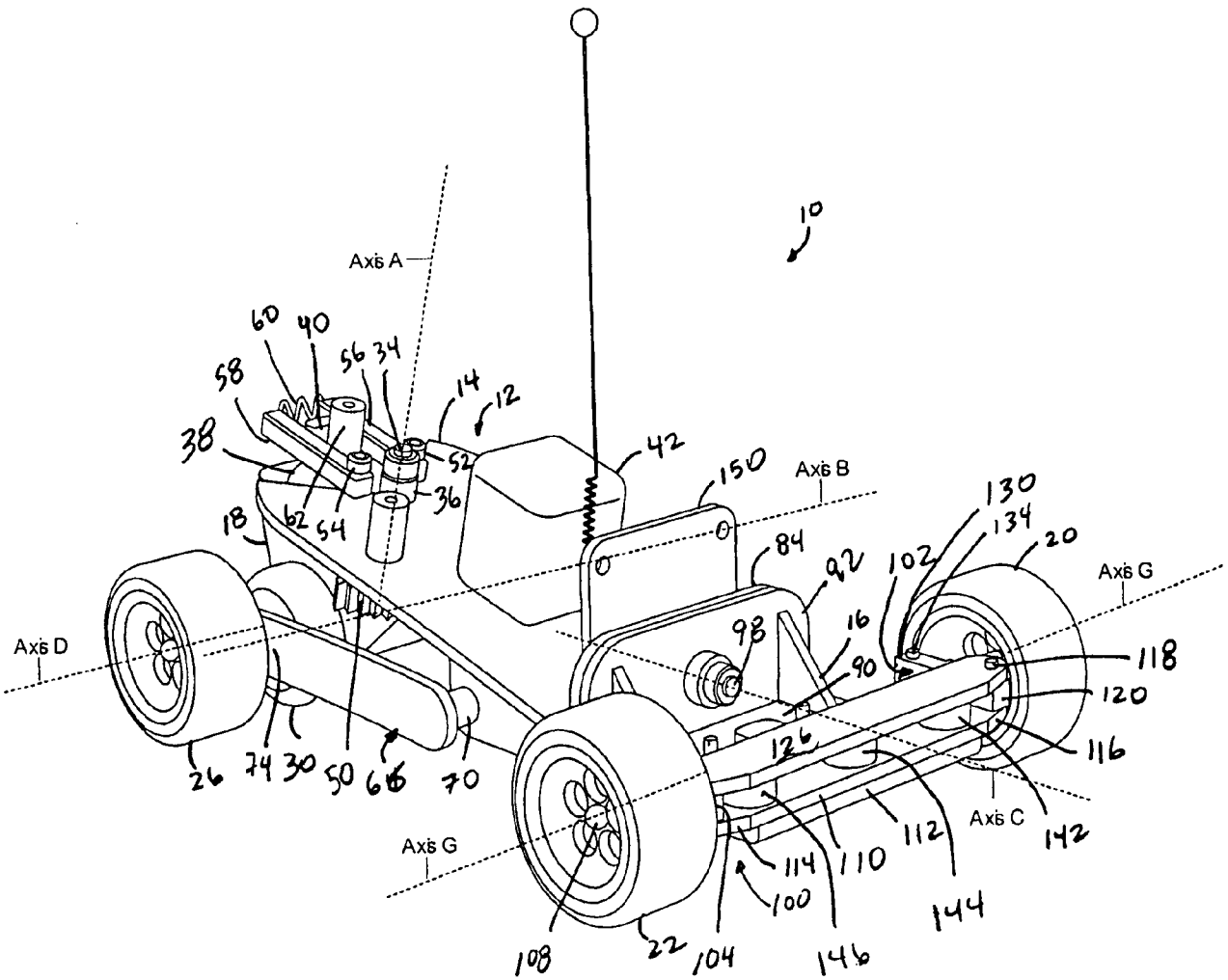
FIG. 1 is a front perspective view of a toy vehicle with its paired castor front wheels and rear drive platform longitudinally aligned for straight-ahead movement and with a battery box omitted to expose swivel centering.

Turning to the Drawings, wherein like numerals denote like components throughout the several views, in FIGS. 1-5, a toy vehicle 10 includes a three-part chassis 12 that is pivotally coupled in order to simulate a drifting maneuver. A main body 14 and a front portion 16 of the chassis 12 appear to be drifting while a rear drive platform 18 that swivels under the main body 14 provides the impetus for the steering by drifting while remaining largely unobserved. The drifting effect is enhanced by having the chassis 12 appear to lean into the turn. Thus, the lean simulates a car suspension being compressed on the turn side of the chassis in response to the sliding contact of a paired front left and right wheels 20, 22 and two paired rear left and right dummy wheels 24, 26 attempting to overcome the sliding momentum of the chassis 12. The effect is further enhanced by a vehicle body (not shown) that would hide the components depicted, except for the front wheels 20, 22 and rear dummy wheels 24,26.

In particular, the rear drive platform 18 swivels about a swivel Axis A that is tipped slightly forward from an otherwise vertical axis, assuming that the toy vehicle 10 rests upon a horizontal surface. The main body 14 is perpendicular to Axis A and level left to right when the rear drive platform 18 is longitudinally aligned, as in FIG. 1. The rear driving platform 18 is supported by paired left and right drive wheels 28,30 connected to one another by a drive axle 32 that spins about an Axis B, which is horizontal.

Figure 2:
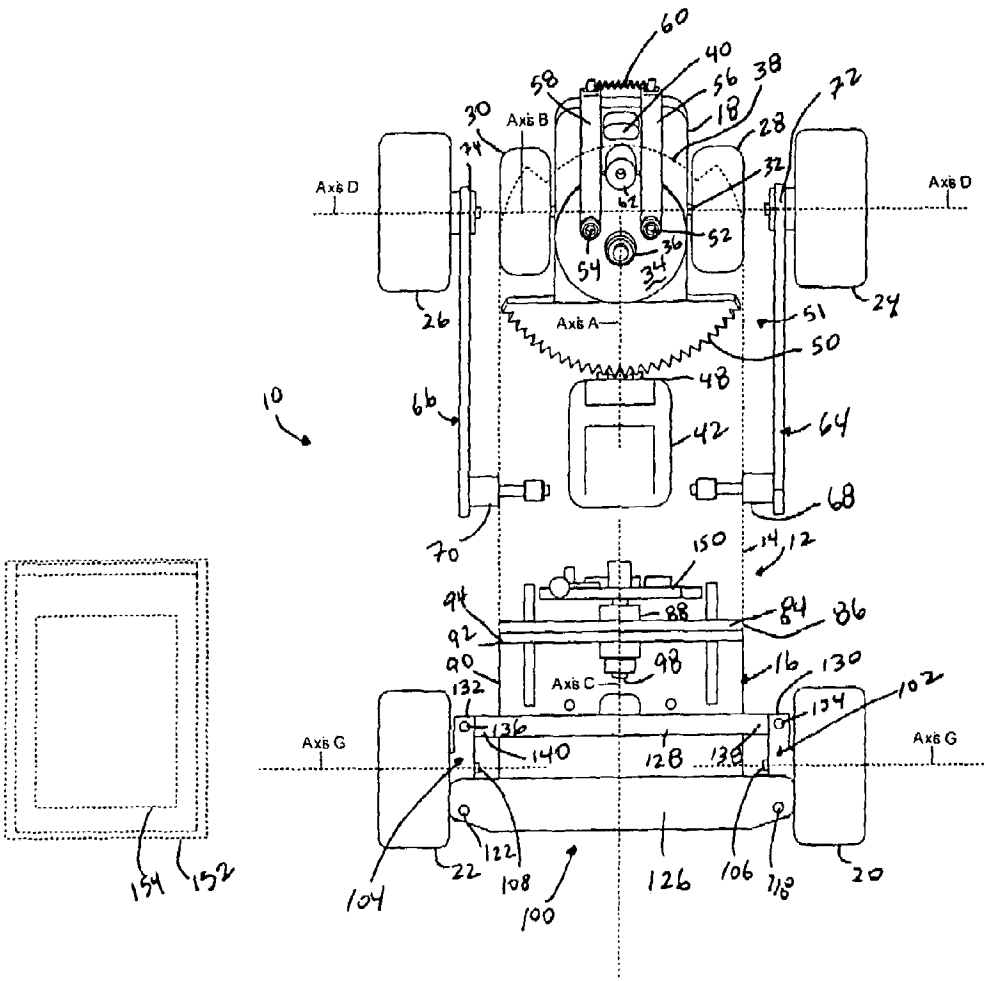
FIG. 2 is a top view of the toy vehicle of FIG. 1 with a main body and rear driving platform shown in phantom and with the battery box exploded to expose a swivel mechanism.
Figure 3:
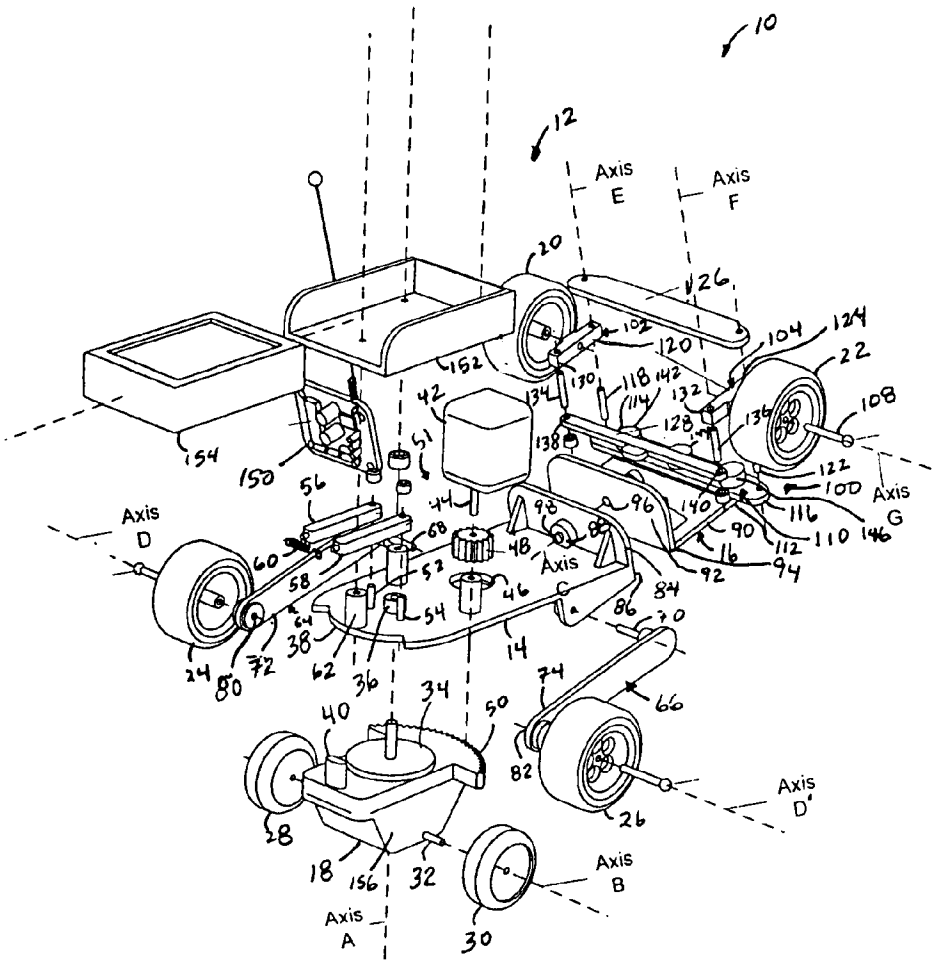
FIG. 3 is a perspective, exploded view of the toy vehicle of FIG. 1.
Figure 4:
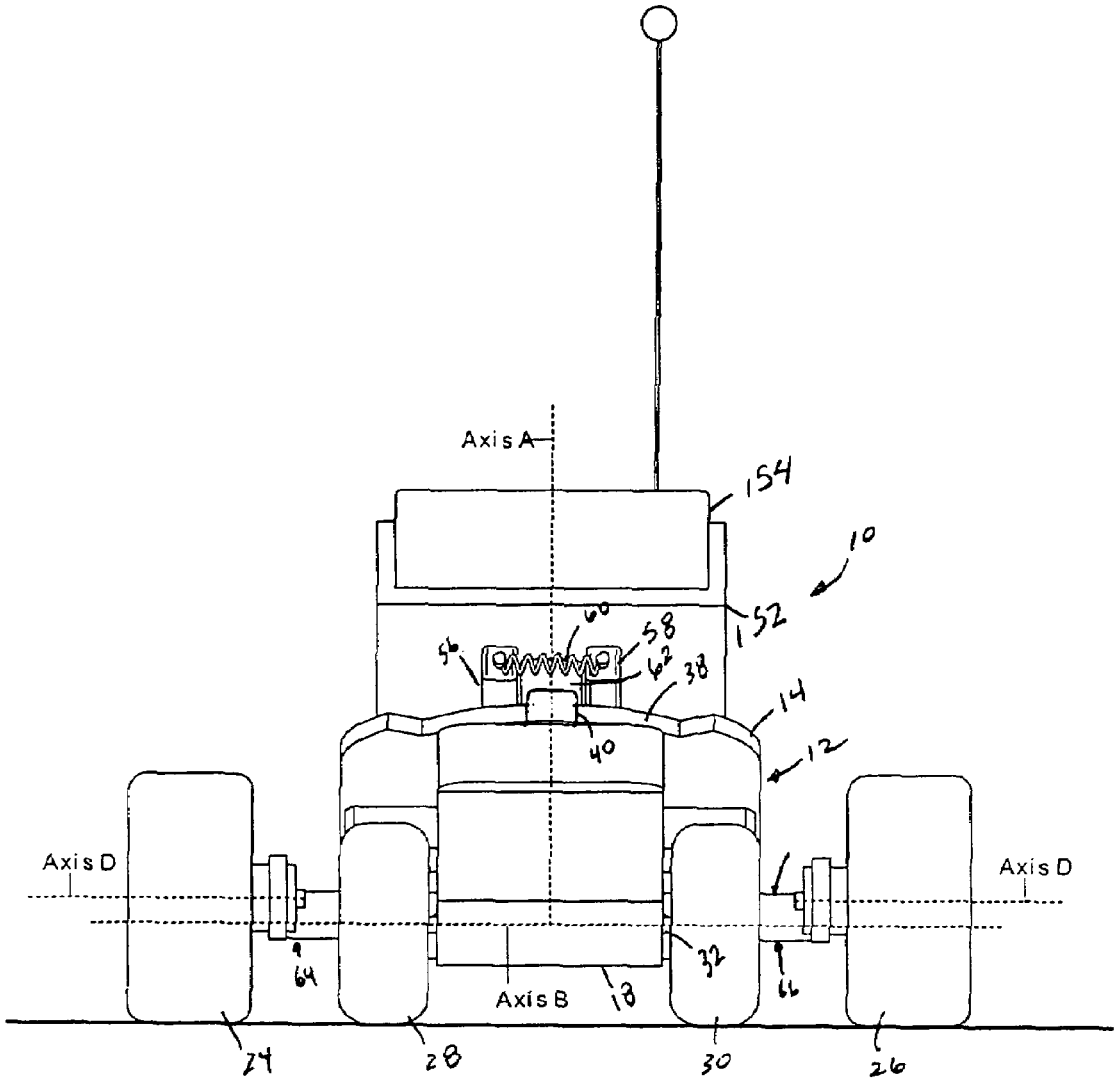
FIG. 4 is a rear view in elevation of the toy vehicle of FIG. 1.

With particular reference to FIGS. 2-3, the rear driving platform 18 includes a spindle table 34 aligned with Axis A that is rotatingly received through a guide 36 formed in the main body 14. A recessed arc surface 38 along an aft portion of the main body 14 receives an upwardly projecting limit block 40 formed in the rear driving platform 18, thus limiting the swivel of the rear driving platform 18. Since the drive wheels 28, 30 remain horizontal as the rear driving platform 18 swivels, the Axis A defined by the swivel table 34 is tipped in a corresponding fashion, such as tipping to the right when the rear driving platform 18 rotates clockwise, as viewed from the top. The main body 14 tips with the spindle table 34.

Figure 5:
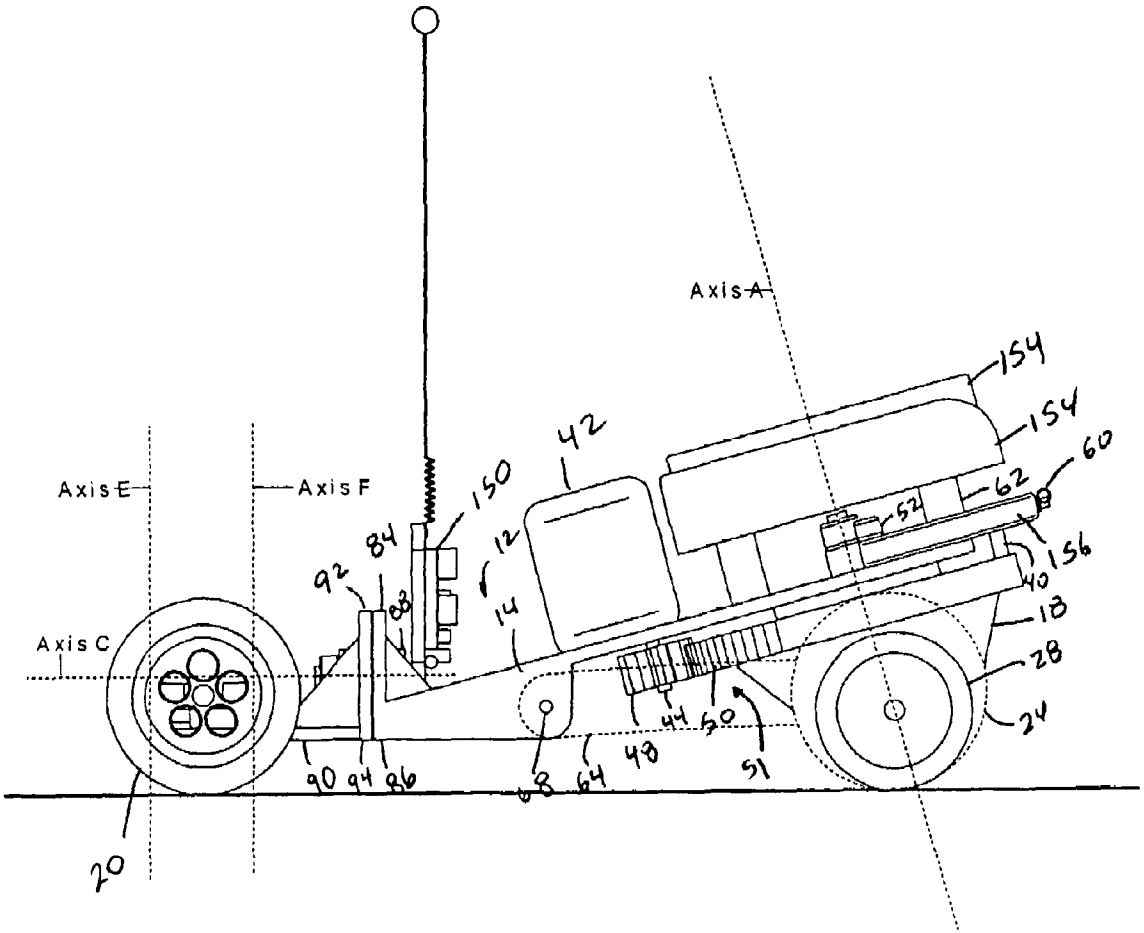
FIG. 5 is a left side view in elevation of the toy vehicle of FIG. 1.
Figure 6:
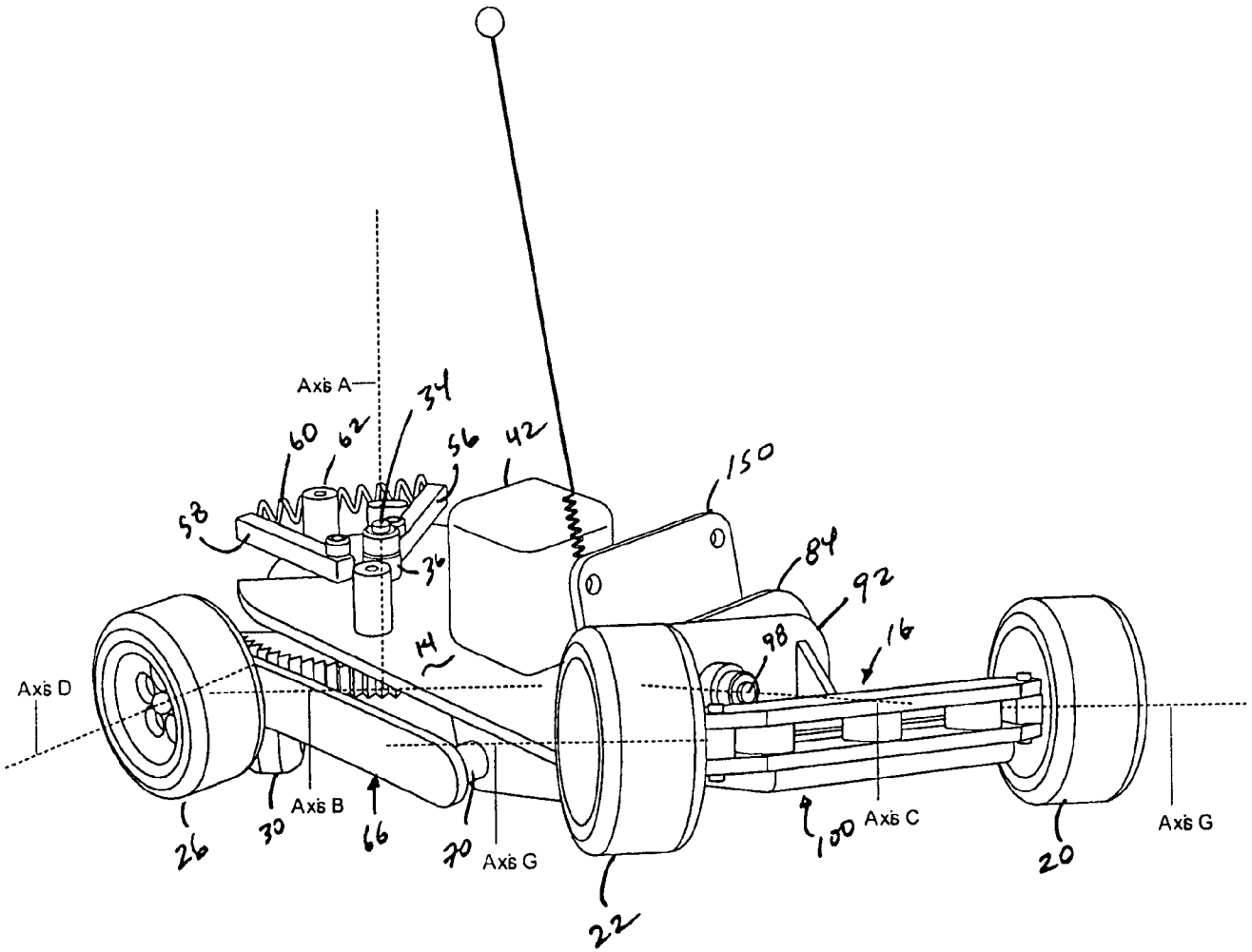
FIG. 6 is a perspective view of the toy vehicle of FIG. 1 with its rear driving platform swiveled to the left and its paired front wheels castoring to the right.
Figure 7:
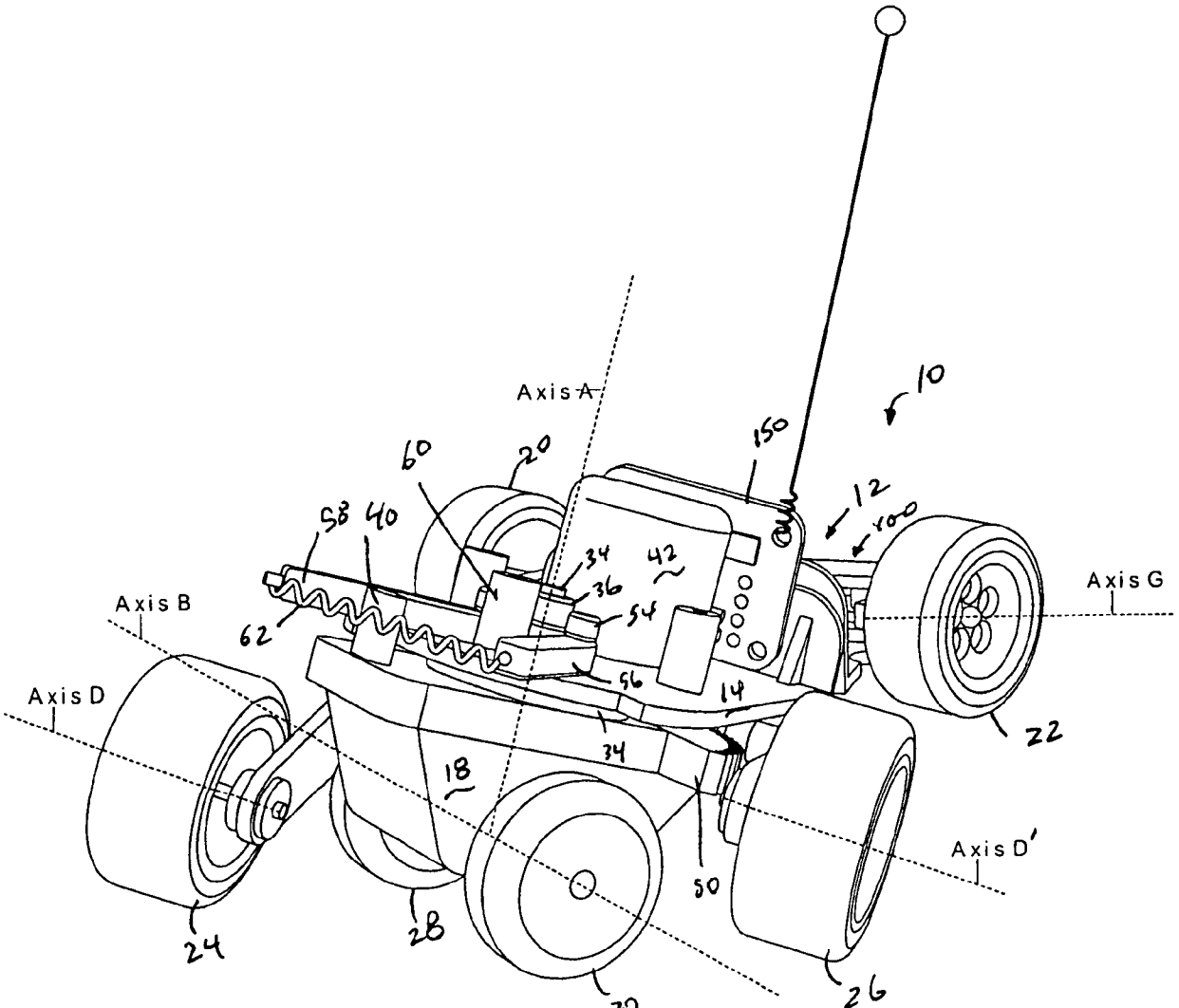
FIG. 7 is a rear perspective view of the toy vehicle of FIG. 6.
Figure 8:
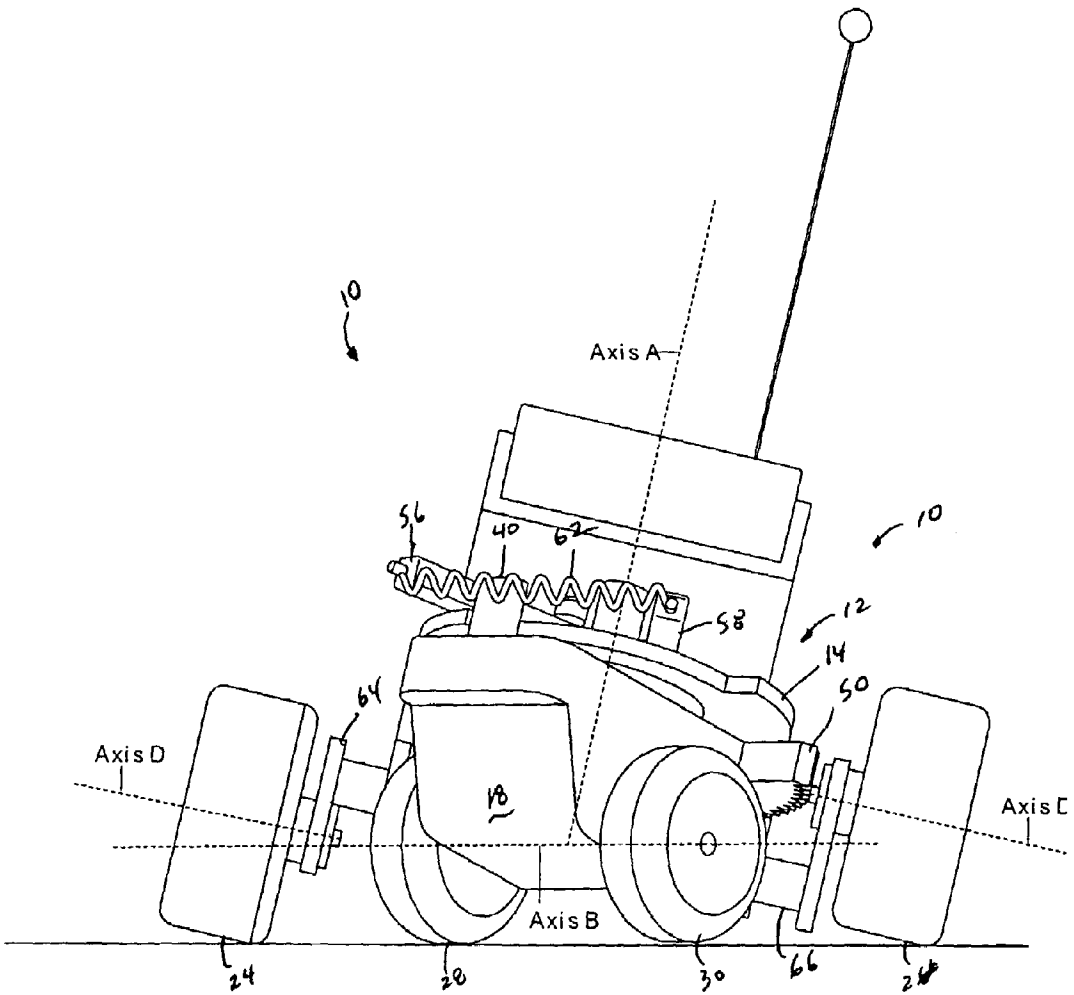
FIG. 8 is a rear view in elevation of the toy vehicle of FIG. 6.
Figure 9:
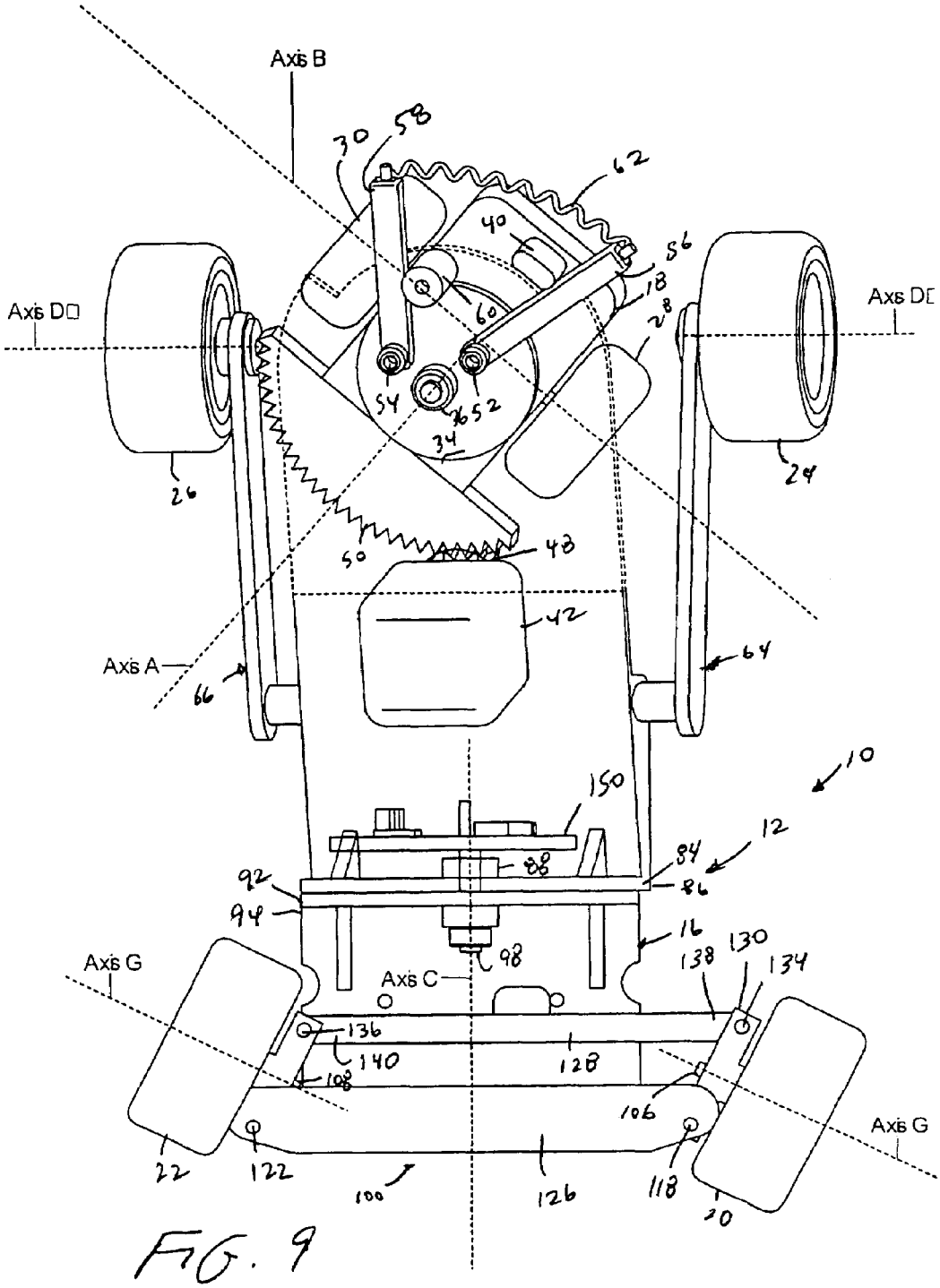
FIG. 9 is a top view of the toy vehicle of FIG. 6.

With particular reference to FIGS. 2, 3 and 5, the swivel of the rear driving platform 18 is caused by a steering motor 42 that is attached to the main body 14. Its swivel output shaft 44 is perpendicularly aligned with the main body 14 and generally downwardly projecting through a hole 46 and attached to a swivel pinion gear 48. An arcing gear segment 50 presented about a front top portion of the rear driving platform 18 and radially aligned with the spindle table 34 meshes with the swivel pinion gear 48. Thus, turning the swivel pinion gear 48 causes the rear driving platform 18 to swivel relative to the main body 14. A gear train 51 formed by the combination is also clutched so when there is no electric load on the motor 42, the gear train 51 can be moved freely to help center, requiring a soft spring to turn the motor 42 on the return travel.

A restoring force assists in returning the rear driving platform 18 to a straight-ahead alignment. In particular, two laterally aligned posts 52, 54 are formed on the main body 14 spaced forward of the recessed arc surface 38 and spaced on each side of the longitudinal axis of the main body 14. Left and right centering arms 56, 58 respectively are pivotally received by the posts 52, 54 at their forward ends, extending backward on each lateral side of limit block 40 of the rear driving platform 18. The centering arms 56, 58 are urged into contact with the limit block 40 by a centering spring 60 attached across rear ends of the centering arms 56, 58 and by a centering pillar 62 formed just forward and centered on the recessed arc surface 38 and projecting upwardly parallel to Axis A. The centering arms 56, 58 pass on each side of the center pillar 62. Thus, each centering arm 56, 58 is prevented from rotating toward the opposite lateral side of the main body 14 past the centering pillar 60 while the other centering arm 56, 58 is forced outwardly by the limit block 40, stretching the centering spring 60, as shown in FIGS. 6-9.

Alternatively, this may be done with a torsion spring and stops that would eliminate the arms. The gear train may also be a controlled servo that would turn and center with electric input to the motor. The motor could be turned off and on with switches at the end of the travel and in the center position.

With particular reference to FIG. 3, the rear left and right dummy wheels 24, 26 are not load bearing but rather are attached to respective left and right trailing arms 64, 66 that are pivotally attached to the main body 14. These rear dummy wheels 24, 26 obscure the rear drive wheels 28, 30 and the rear driving platform 18 to enhance the illusion of drifting. A respective forward pivoting end 68, 70 of each trailing arm 64, 66 is aligned with an Axis C that is laterally transverse to the plane of the main body 14 and is perpendicular to Axes A and B. Respective back ends 72, 74 of each trailing arm 64, 66 present a pin hole 80, 82 respectively aligned with an Axis D and Axis D' that are parallel to Axis C. When the toy vehicle 10 is in its straight ahead condition (i.e., rear driving platform 18 not swiveled), the Axes D and D' of the dummy rear wheels 24, 26 are the same and are horizontal. When the toy vehicle 10 turns, as in FIG. 7, the axes D and D' are parallel but not equal since the trailing arms 64, 66 each pivot to maintain the dummy rear wheels 24, 26 in contact with the underlying surface and their forward pivoting ends 68, 70 lean as Axis C tips from the horizontal along with the main body 14.

Returning to FIGS. 1-3, the drifting effect is enhanced by a castoring front portion 16 of the chassis 12, allowing a change in the turn radius. A lateral front flange 84 is upwardly oriented and attached across a front edge 86 of the main body 14 and projecting upwardly to receive the front portion 16 through a horizontally and longitudinally aligned guide 88. The front portion 16 of the chassis 12 includes a horizontal front deck 90 with a lateral back flange 92 upwardly oriented and across a rear edge 94 of the front deck 90. A guide hole 96 in the lateral back flange 92 is registered to the guide 88 in the lateral front flange 84 to receive a pin 98. The main body 14 tips left or right about the pin 98 as the front portion 16 remains horizontal with the front wheels 20, 22 remaining on the underlying surface.

The front wheels 20, 22 castor in unison by being coupled to the front portion 16 of the chassis 12 by a front steering assembly 100. Left and right castoring wheel supports 102, 104 reside horizontally respectively along an inside diameter of each front wheel 20,22. Left and right front axles 106, 108 respectively pass through each front wheel 20, 22 and midpoints of castoring wheel supports 102, 104 to pin the respective wheel 20,22 for rotation. A lower front plate 110 laterally crosses a front edge 112 of the horizontal front deck 90 of the front portion 16 of the chassis 12. The lower front plate 110 extends laterally to each side to expose left and right tabs 114, 110. A left front spindle 118 vertically spaces and rotationally attaches the left tab 114 to a front end 120 of the castoring left wheel support 102. Similarly, a right front spindle 122 vertically spaces and rotationally attaches the right tab 116 to a front end 124 of the right castoring wheel support 104. The front ends 120, 122 of the left and right castoring wheel supports 102, 104 are also laterally spaced and allowed to horizontally pivot to an upper front chassis plate 126.

A steering link 128 is laterally aligned aft of and below the front upper chassis plate 126 for spacing rear ends 130, 132 respectively of the left and right castoring wheel supports 102, 104. In particular, left and right rear spindles 134, 136 respectively vertically space and couple for horizontal rotation of each rear end 130, 132 above left and right lateral ends 138, 140 of the steering link 128. Three vertical spacers 142-146 are laterally spaced and attached to the upper surface of the lower front plate 110 for providing a surface upon which the upper front chassis plate 126 and the steering link 128 may rest.

Figure 10:
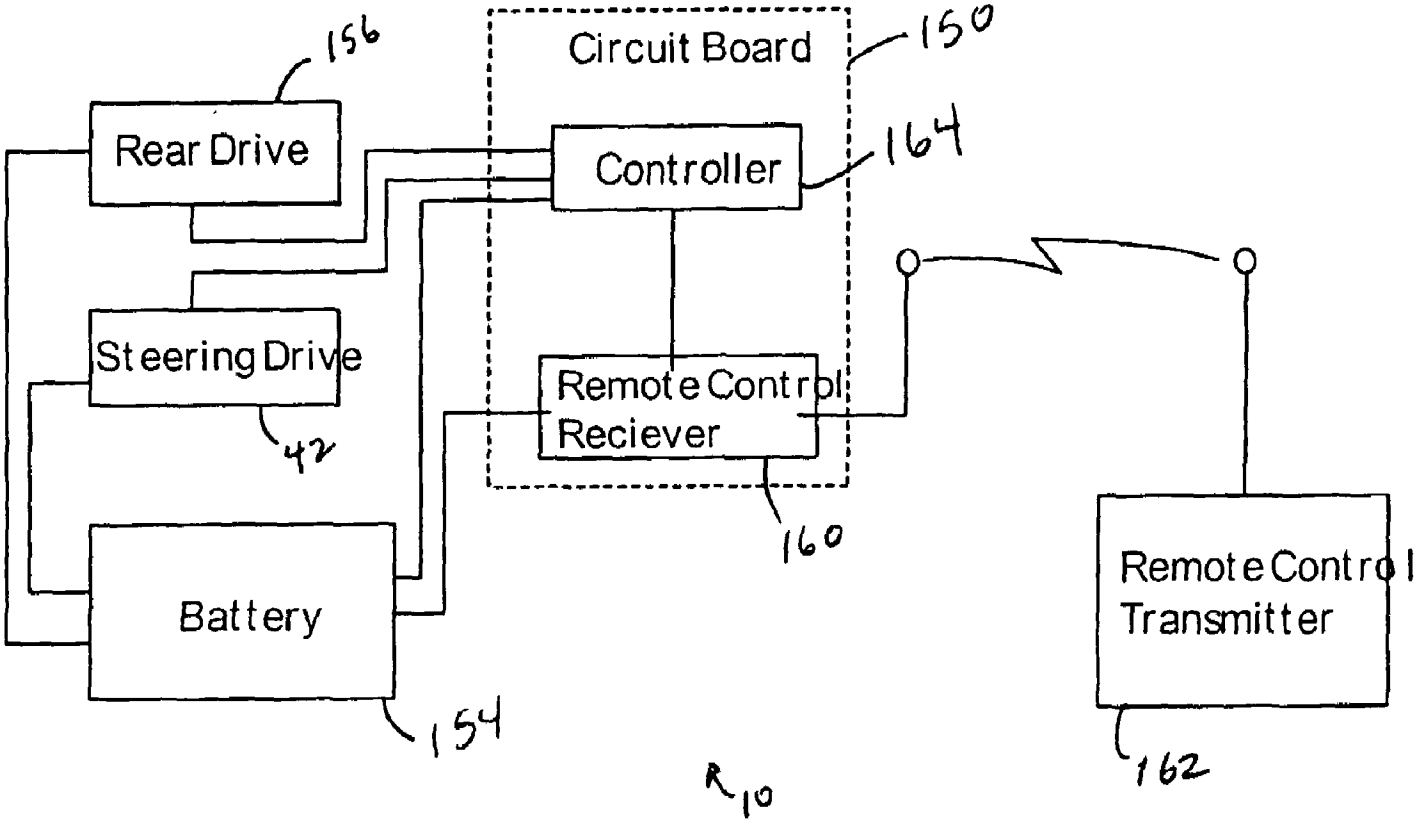
FIG. 10 is a block diagram of a remote control system for the toy vehicle of FIG. 1.

Power and control for the toy vehicle 10 are provided by a controller module 150 that is attached to the main body 14, a battery box 152 is also attached to the main body 14 and engages a battery (or batteries) 154. Inside the rear driving platform 18 is a drive motor 156. With reference to FIG. 10, the control module ("Circuit Board") 150 includes a remote control receiver 160 that is in electromagnetic communication with a remote control transmitter 162, that is typically a detached portable device that accompanies the toy vehicle 10. Commands for driving and/or turning are interpreted by a controller circuit 164 and transmitted respectively to the driving motor ("Rear Drive") 156 and the steering motor 42, each powered by the battery 154.

In use, the remote control transmitter 162 transmits a command to the toy vehicle 10 to drive. The remote control receiver 160 receives the drive command, relays the drive command to the controller circuit 164, which in turn activates the rear drive motor 156. The rear drive platform 18 straightens under the influence of the centering arms 56, 58, centering spring 60 and centering post 62 and turns the drive wheels 28, 30 to propel the vehicle 10. When the remote control transmitter 162 transmits a turn command, the remote control receiver 160 and control circuit 164 command the steering motor 42 to swivel toward the command turn direction, thus rotating the main body 14 of the chassis 12 in the opposite direction, appearing to slide out of the turn (drift). Since the rear drive platform 18 is tipped slightly downward to its front, the rear drive platform tips the main body 14 to the opposite lateral side to the swivel of the rear drive platform 18. Dummy rear wheels 24, 26 supported by trailing arms 70, 72 obscure the action of the rear drive platform 18. Front wheels 20, 22 castor in the direction of movement of the toy vehicle 10 by a front steering assembly 95, which is attached to a front portion 16 of the chassis 12 that does not tilt but instead is pivotally attached to the main body 14.

While preferred embodiments of the present invention have been shown and described herein, it will be obvious to those skilled in the art that such embodiments are provided by way of example only. Numerous variations, changes, and substitutions will now occur to those skilled in the art without departing from the invention. In addition, it should be understood that every structure described above has a function and such structure can be referred to as a means for performing that function.

For example, it should be appreciated that aspects of the present invention for drifting would apply to applications wherein a user control is directly wired to a control module, is a preprogrammed routine for the toy vehicle to perform, or is in response to sensed parameters (e.g., the toy vehicle follows markings or other indicators on the under surface).

As another example, instead of two rear drive wheels 28, 30, one drive wheel may be used. The drive motor 156 may be capable of discrete or a continuous range of speeds, including forward and reverse.

As yet another example, some subset of the features of a swiveling, obscured rear driving platform: dummy rear wheels; a non vertical Axis A that induces a chassis to tilt when turning; and a horizontal, castoring front end may be used rather than all of these features in combination.

As yet an additional example, motorized vehicles that may be ridden by a child may advantageously incorporate mechanisms as described herein to create a drifting effect. Since such vehicles are generally not capable of going fast enough to actually drift, this effect may be particularly entertaining.

As yet a further example, while castoring the front wheels in combination with a selectively steered rear end successfully achieves drifting and controlled turns, an application consistent with the present invention may include steered front wheels, such as front wheels turning in a fixed relation to the angle of the swivel of the rear drive platform. Alternatively, steered front wheels may perform independently of the drifting ability. For example, an additional control or a determination made based on the commanded speed and degree of turn may cause the drifting mode to be enabled such that the rear drive platform is swiveled.

What is claimed is:

1. A toy device, comprising:

a chassis;

paired front wheels attached to a front portion of the chassis;

a rear drive platform pivotally attached to the chassis wherein the rear drive platform is operatively configured to drive the chassis, wherein the rear drive platform and the chassis are engaged at a non-vertical coupling defining a non-vertical axis, wherein the rear drive platform has a downwardly sloped upper surface at the non-vertical coupling, the chassis rotatingly supported on the downwardly sloped surface to tilt in response to the rotation of the rear drive platform about the non-vertical axis defined by the non-vertical coupling; and a swivel mechanism operatively configured to pivot the rear drive platform about the non-vertical axis, relative to the chassis to effect a drifting turn maneuver.

2. The toy device of claim 1, further comprising:

a pair of pivoting trailing arms, each having a front end pivotally attached to respective lateral sides of the chassis; and a pair of dummy rear wheels, each coupled for rotation on a back end of a respective one of the pair of pivoting trailing arms.

3. The toy device of claim 1, further comprising:

a drive motor in the rear driving platform;

a steering motor in geared engagement to the rear driving platform; and a control circuit operably configured to actuate the drive motor and the steering motor.

4. The toy device of claim 3, further comprising:

a detached remote control transmitter operably configured to respond to a drive command and to a turn command; and a remote control receiver responsive to a remote control transmitter by relaying the drive and turn commands to the control circuit.

5. The toy device of claim 1, further comprising a front steering assembly operatively configured to pivotally couple each front wheel to castor.

6. The toy device of claim 5, wherein the chassis further comprises a main body and a pivotally attached front portion, the front portion remaining aligned to an underlying support surface under the paired front wheels as the main body tilts in response to swiveling of the rear driving platform.

7. A toy device, comprising:

a chassis;

at least one front wheel attached to a front portion of the chassis;

a rear drive platform attached under the chassis and operatively configured to drive the chassis wherein the rear drive platform and the chassis are engaged at a non-vertical coupling defining a non-vertical axis, the chassis being rotatingly supported at the non-vertical axis defined by the non-vertical coupling, at a selected nonzero angle relative to a longitudinal axis of the chassis, wherein the rear drive platform comprises at least one driven wheel; and a pair of nondriven rear wheels attached to the chassis, positioned to obscure the rear drive platform, wherein the pair of nondriven wheels are attached to the chassis such that the pair of nondriven wheels do not bear weight of the chassis.

8. The toy device of claim 7, the toy device further comprising a swivel mechanism operatively configured to pivot the rear drive platform to the chassis to effect a drifting turn maneuver.

9. The toy device of claim 8, wherein the rear drive platform has a downwardly sloped upper surface, the chassis rotatingly supported on the downwardly sloped surface to tilt in response to the rotation of the rear drive platform.

10. The toy device of claim 9, wherein the pair of nondriven rear wheels attached to the chassis comprise:

a pair of pivoting trailing arms, each having a front end pivotally attached to respective lateral sides of the chassis; and a pair of dummy rear wheels, each coupled for rotation on a back end of a respective one of the pair of pivoting trailing arms.

11. The toy device of claim 7, further comprising:

a drive motor in the rear driving platform;

a steering motor in geared engagement to the rear driving platform; and a control circuit operably configured to actuate the drive motor and the steering motor.

12. The toy device of claim 11, further comprising:

a detached remote control transmitter operably configured to respond to a drive command and to a turn command; and a remote control receiver responsive to a remote control transmitter by relaying the drive and turn commands to the control circuit.

13. The toy device of claim 7, further comprising a front steering assembly operatively configured to pivotally couple the at least one front wheel to castor.

14. The toy device of claim 13, wherein the chassis further comprises a main body and a pivotally attached front portion, the front portion remaining aligned to an underlying support surface under the paired front wheels as the main body tilts in response to swiveling of the rear driving platform.

15. A toy device, comprising:

a chassis;

a front wheel mechanism supporting a front portion of the chassis;

a means for driving a rear portion of the chassis at a selected angle with respect to a longitudinal axis of the chassis, wherein the means for driving is operable to pivot relative to the chassis, wherein the means for driving is configured to incline the chassis relative to a horizontal plane, wherein the means for driving is further configured to laterally tilt the chassis relative to a vertical axis, in addition to inclining the chassis relative to a horizontal plane, upon pivoting of the means for driving relative to the chassis.

16. The toy device of claim 15, further comprising a means for castoring the front wheel mechanism.

17. The toy device of claim 15, further comprising a means for visually obscuring the driving means.

* * * * *